US007370682B2

(12) United States Patent
Wong

(10) Patent No.: US 7,370,682 B2
(45) Date of Patent: May 13, 2008

(54) ROLLER SHUTTERS

(76) Inventor: Lok Y. Wong, 45, Jurong East Avenue 1, #02-04 Parc Oasis (SG) 609779

( * ) Notice: Subject to any disclaimer, the term of this patent is extended or adjusted under 35 U.S.C. 154(b) by 342 days.

(21) Appl. No.: 10/702,060

(22) Filed: Nov. 4, 2003

(65) Prior Publication Data

US 2005/0072089 A1 Apr. 7, 2005

(51) Int. Cl.
*E06B 9/08* (2006.01)

(52) U.S. Cl. ..... 160/133; 160/183; 160/235

(58) Field of Classification Search ..... 160/133, 160/183, 235, 32, 33, 36, 199, 201
See application file for complete search history.

(56) References Cited

U.S. PATENT DOCUMENTS

| | | | | |
|---|---|---|---|---|
| 4,345,635 | A * | 8/1982 | Solomon | 160/133 |
| 4,386,645 | A | 6/1983 | Dever | 160/183 |
| 4,660,613 | A * | 4/1987 | Dagenais | 160/199 |
| 5,575,322 | A | 11/1996 | Miller | 160/133 |
| 5,586,592 | A * | 12/1996 | McGregor | 160/133 |
| 5,850,862 | A * | 12/1998 | Miller | 160/133 |
| 6,085,822 | A * | 7/2000 | Miller | 160/133 |
| 6,422,289 | B1 | 7/2002 | Miller | 160/133 |
| 6,722,415 | B2 * | 4/2004 | Mochizuki et al. | 160/235 |
| 6,874,560 | B2 * | 4/2005 | Escribano | 160/133 |
| 2003/0037888 | A1 | 2/2003 | Mochizuki | 160/201 |

FOREIGN PATENT DOCUMENTS

| | | |
|---|---|---|
| DE | 2451189 | 2/1976 |
| EP | 1286017 A2 | 2/2003 |
| FR | 2173835 | 10/1973 |
| GB | 2204899 A | 11/1988 |
| SG | 54616 | 4/2001 |
| WO | WO 98/19038 | 5/1998 |

OTHER PUBLICATIONS

ESRO Aluminum Roller Grills LM72 and LM82 "The Burglary Protection made of Extruded Aluminum Profiles" A Brochure by German company Erlauer Sicherheitsrolladen GmbH.

* cited by examiner

*Primary Examiner*—David Purol
(74) *Attorney, Agent, or Firm*—Pillsbury Winthrop Shaw Pittman LLP

(57) ABSTRACT

A rolling door or shutter (1) has a series of preferably planar panels (3, 3A) which are joined by pairs (6) of pivotally connected hinge members (7, 8). The shutter slides up and down with its side edges guided in tracks (2). When the shutter is closed, e.g. against a bottom sill, the hinge members of each pair (6) pivot about one another to jam between opposing walls (30, 31) of the guide tracks. The pivotal range of each hinge pair may be limited to prevent the hinge pair from straightening when the shutter is suspended. This ensures the hinge pairs always fold in the same way when the shutter is closed. The panels may be rolled steel, extruded aluminium, moulded (optionally transparent) polycarbonate plastic, or tempered glass sheets fitted with edge cappings.

13 Claims, 11 Drawing Sheets

ROLLER SHUTTERS

This Application is a national application of and claims the benefit of priority from Singapore Application No. 200305892-2 which was filed on Oct. 6, 2003.

FIELD OF INVENTION

The present invention relates to segmented panel shutters, including doors, for removably closing over an opening (for example a portal or door opening), or for providing a removable protective cover over another closure such as a door or window (for example for providing greater security against unauthorised intruders or protection against weather extremes). The rolling shutter or door is typically guided by sliding engagement of its opposite parallel edges by parallel guides and may be rolled up about a cylindrical roller or drum when not closed over the opening or other closure.

BACKGROUND

Rolling doors of the prior art have linked panels or segments that can be drawn away from an opening and rolled around a cylinder or drum.

Singapore Patent SG 54616 describes a transparent rolling door having panels that are each made up from sections of transparent plastics material. Brackets fitted to the top edge of each panel engage complementary brackets fitted to the bottom edge of the next panel above to link the panels together. The engagement of the brackets allows the linked panels to wrap around a roller. The brackets, which may be made from extruded aluminium, are attached to the panel edges, for example by screws.

U.S. Patent Application No. 2003/0037888 describes a roller shutter having transparent panels made from a synthetic resin. Adjacent panels are hinged together by the engagement of fitted caps or integrally-formed rounded edges, along the long edges of each panel, in respective C-shaped slots of a hinge member. The short edges of each panel and hinge member slide in a pair of guide rails. The hinging angle of adjacent panels is limited to ensure the shutter slides smoothly without jamming in the guide rails.

U.S. Pat. No. 6,422,289 describes a rolling shutter assembly in which adjacent slats are pivotally linked together in pairs, each pair being linked to adjacent pairs of slats by a hinge member. The relative rotation at the pivotal link between slats is restricted to ensure that, as the shutter is unrolled, each slat collapses onto its adjacent lower slat in the desired V-shaped pattern. Upward movement of an upper slat is restricted by engagement with a bracket to prevent the shutter from being opened by lifting from a lower slat, and to prevent upper slats from riding up when a force is applied to flatten the V-shapes of the hinged slats. The width, ie height, of one of the slats is selected or is adjustable to match the height of the shutter to that of the opening over which the shutter is fitted.

SUMMARY OF INVENTION

The object of at least one aspect of the present invention is to provide a rolling shutter which, when closed, is automatically secured to resist unauthorised opening but which slides freely upward when an upper part of the shutter is lifted from above.

In broad terms a first aspect of the invention may be said to be a shutter for a rolling shutter assembly, the shutter including a series of shutter panels, each panel having first and second opposite substantially straight edges, wherein adjacent shutter panels in the series are pivotally connected together by first and second pivotally linked hinge members, each hinge member has first and second opposite substantially straight edges, the second edge of a first said shutter panel is pivotally attached by a first pivotal attachment to the first edge of the first hinge member, the second edge of the first hinge member is pivotally attached by a second pivotal attachment to the first edge of the second hinge member, the second edge of the second hinge member is pivotally attached by a third pivotal attachment to the first edge of a second shutter panel, and the second shutter panel is adjacent to said first shutter panel.

The angular pivotal range of at least one of said pivotal attachments may be constrained to maintain the pivotal axis of the second pivotal attachment offset to one side of an imaginary plane in which the pivotal axes of the first and third pivotal attachments lie.

In a first alternative of the shutter, each shutter panel has a substantially planar portion which extends between said first and second edges of the shutter panel, and each of the first and second edges of each shutter panel is terminated by a bead which extends along the respective edge and has a partly circular transverse cross-sectional outline.

The shutter panels of the first alternative of the shutter may be made from aluminium or an aluminium alloy, and are preferably extruded.

Alternatively, the shutter panels may be made from a plastics material, and preferably from a substantially transparent polycarbonate material.

Optionally, the substantially planar portion of each shutter panel is made from glass and each beaded edge is provided by fitting a capping having a C-shaped transverse cross-section to the planar glass portion, along each of said first and second edges of the panel, the C-shaped cross-section having a substantially circular outline.

Preferably, the glass is tempered and the C-shaped capping is an extrusion of aluminium or aluminium alloy which is attached to the planar glass portion using an adhesive.

Preferably, each hinge member is elongate and has a transverse cross-section which is substantially constant along the length of the hinge member, the first and second edges of the first hinge member and the second edge of the second hinge member are each shaped to form a socket with a partly circular transverse cross-section, a bead extends along the first edge of the second hinge member and has a partly circular transverse cross-sectional outline, and said pivotal attachments are provided by respective engagement of said beads inside said sockets.

Preferably, each hinge member is extruded from aluminium or an aluminium alloy.

Preferably, the beads and sockets are configured to provide the constraint.

In a second alternative of the shutter, each shutter panel has a substantially planar portion which extends between said first and second edges of the shutter panel, and the first and second edges of the shutter panels are each terminated by a curved portion which extends along the respective edge.

The shutter panels of the second alternative may be made from sheet steel, and are preferably rolled.

Preferably each hinge member is elongate and has a transverse cross-section which is substantially constant along the length of the respective hinge member, the first and second edges of the first hinge member and the first and second edges of the second hinge member are each shaped with a curved portion which extends along the length of the respective edge, and said first, second and third pivotal attachments are provided by engagement of respective pairs of said curved portions.

Each hinge member may be made from sheet steel.

In broad terms a second aspect of the invention may be said to be a rolling shutter assembly, the assembly including the shutter of the first aspect and the preferences and options of the first aspect, the assembly also including a pair of substantially vertical guide tracks and a shutter support, wherein the shutter has a pair of opposite substantially parallel side edges which are substantially perpendicular to said first and second edges of the shutter panels and are engaged respectively in the guide tracks when the shutter is closed, the shutter support is located in the vicinity spanning the upper ends of the guide tracks, the shutter support rotates about an axis that is substantially parallel to said edges of the shutter panels, and when the shutter is opened the shutter is retracted from the guide tracks and rolled about the shutter support.

Preferably, each vertical guide track has a pair of parallel side walls, and said side edges of the shutter slide up or down between said track walls of a respective vertical track to guide the shutter as it moves between opened and closed states.

Preferably, each pair of first and second hinge members pivotally connecting adjacent shutter panels in said series is configured to open when an upwardly directed force is applied to the upper edge of the upper one of said pair of hinge members while a downwardly directed force is applied to the lower edge of the lower one of said pair of hinge members and, when thus opened, to be dimensioned to be freely slidable up or down between each pair of parallel side walls of the guide tracks, and said pair of first and second hinge members is configured to close when a downwardly directed force is applied to the upper edge of the upper one of said pair of hinge members while an upwardly directed force is applied to the lower edge of the lower one of said pair of hinge members and, when thus forced toward a closed configuration, is dimensioned to jam between each pair of parallel side walls of the guide tracks.

Preferably, the upper edge of the upper one of each said pair of hinge members and the lower edge of the lower one of each said pair of hinge members lie on a substantially common plane when each said pair of hinge members is jammed between the parallel walls of the guide tracks.

The invention may further be said to consist in any alternative combination of parts or features mentioned herein or shown in the accompanying drawings. Known equivalents of these parts or features which are not expressly set out are nevertheless deemed to be included.

BRIEF DESCRIPTION OF DRAWINGS

It will be appreciated that a rolling shutter and an assembly including such a shutter may be implemented in various forms. Preferred embodiments of the invention will now be described, by way of example only and without intending to be limiting, with reference to the accompanying drawings of which.

DETAILED DESCRIPTION OF THE PREFERRED EMBODIMENT

In this description, various features are referred to by relative positions or orientations; for example, by terms such as "upper", "lower", "bottom" and "rearward". These and similar references are given to aid in the understanding of the invention when the rolling shutter assembly or its components are generally in the orientations shown in the figures. The invention may be conveniently used in this orientation, i.e. with vertical guide tracks so that the shutter, when closed, is vertical. However, the invention is not limited to this particular orientation.

Like components or features are labelled with like numerals throughout the figures.

Figure 1:
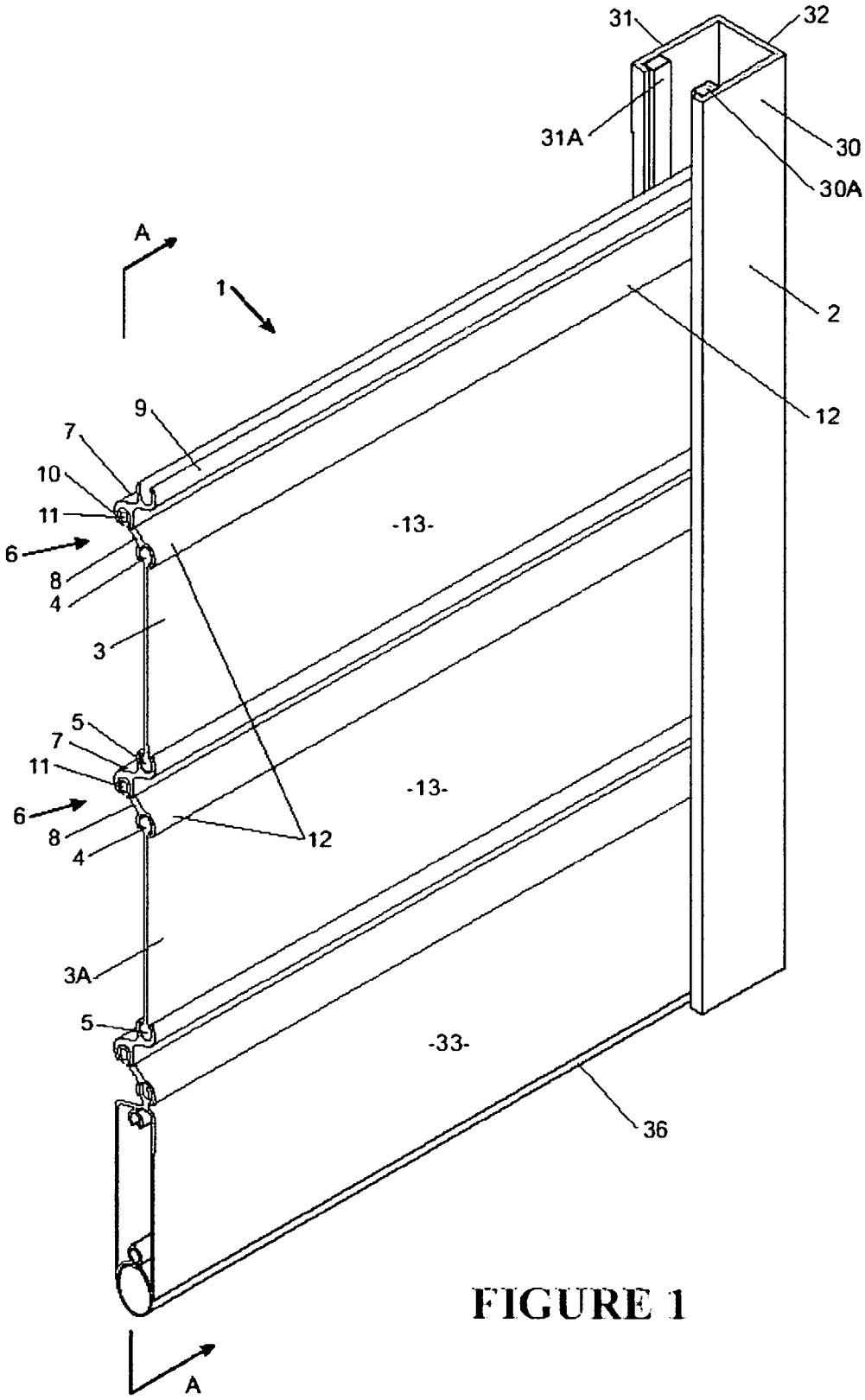
FIG. 1 shows a perspective front view of a lower right corner fragment of a rolling shutter assembly having a shutter which is closed over an opening.
Figure 2:
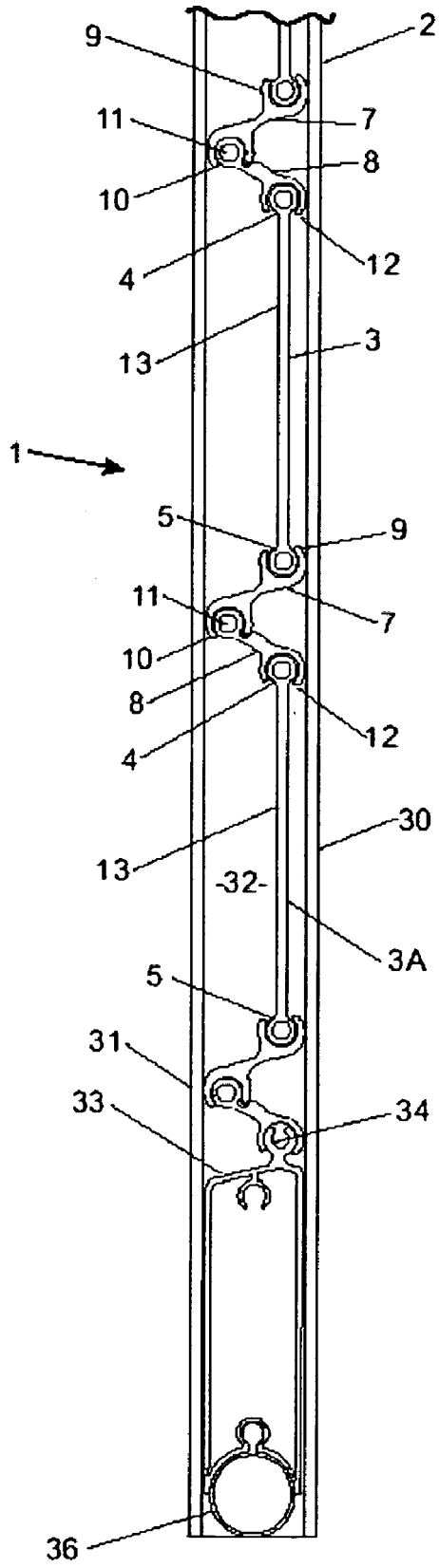
FIG. 2 shows an end elevation of the fragment of the rolling shutter assembly as seen at line A-A' of FIG. 1, with the shutter resting on the bottom of the opening.
Figure 3:
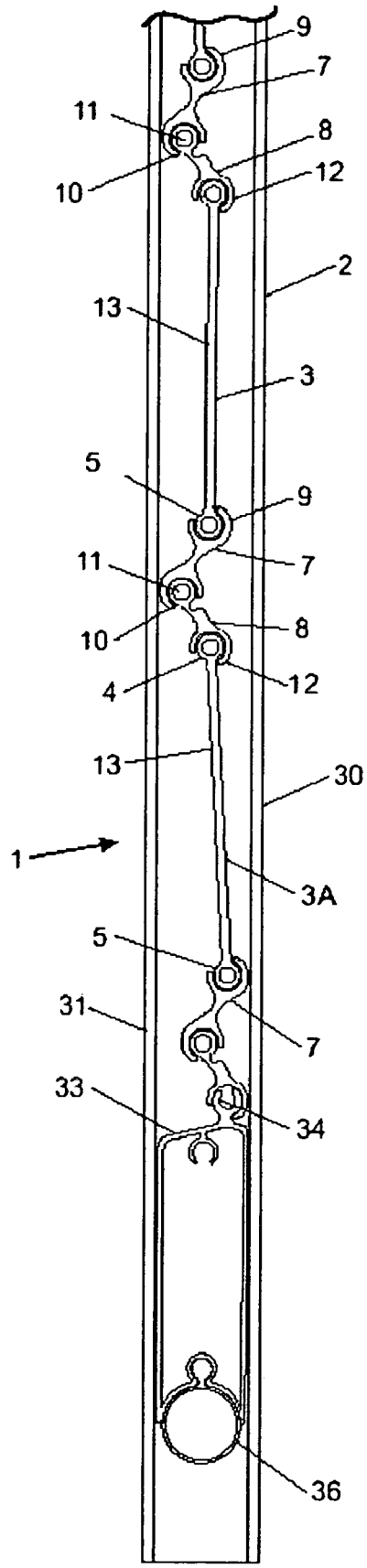
FIG. 3 shows an end elevation of the fragment of the rolling shutter assembly as seen at line A-A' of rolling shutter assembly of FIG. 1, with the shutter suspended and only partly closed over the opening.

FIGS. 1 to 3 show a shutter assembly which includes a door or shutter 1. The two side edges of the shutter respectively slide in a pair of parallel guide tracks 2. The shutter is raised to open the shutter and may be rolled about a rotating roller (not shown) which is mounted above the top ends of the guide tracks.

Figure 5:
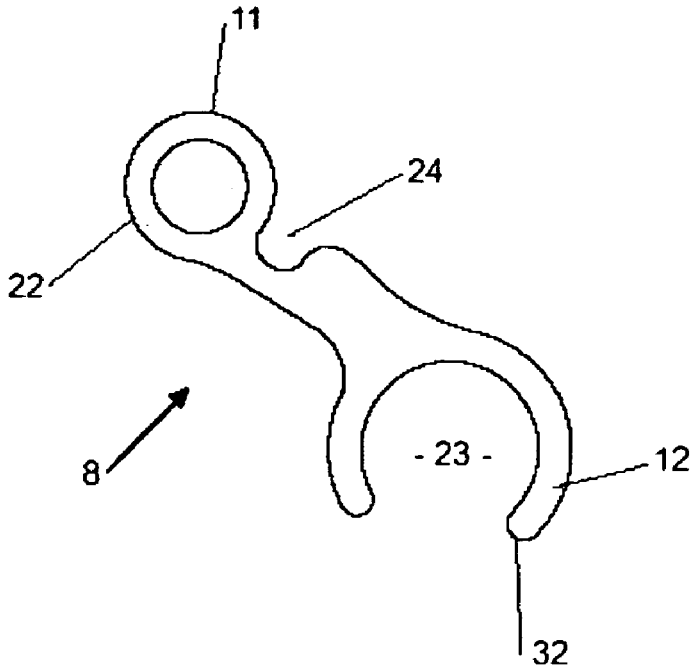
FIG. 5 is a transverse cross-section of a second hinge member of the shutter seen in FIGS. 1 to 3.
Figure 6:
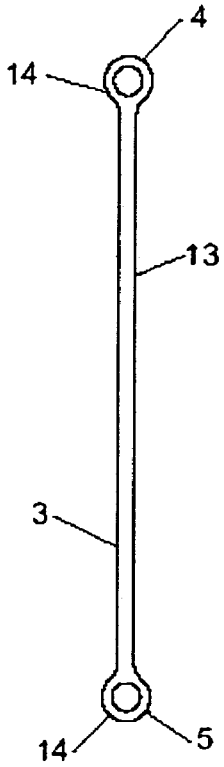
FIG. 6 is a transverse cross-section of a shutter panel suitable for use in the shutter seen in FIGS. 1 to 3.
Figure 7:
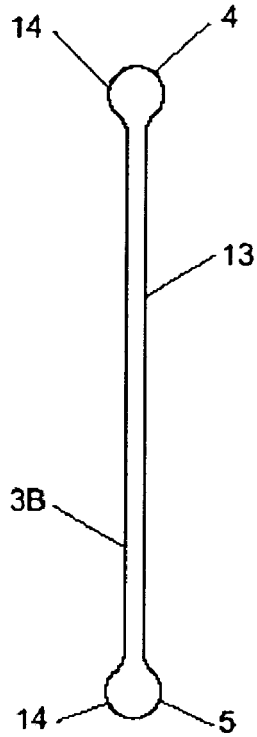
FIG. 7 is a transverse cross-section of an alternative shutter panel suitable for use in the shutter seen in FIGS. 1 to 3.

The shutter includes a series of shutter panels 3, some alternatives of which are shown in more details in FIGS. 6 and 7. Each shutter panel has upper and lower edges 4, 5 which are straight and parallel, and are perpendicular to the guide tracks. Adjacent shutter panels in the series are pivotally connected together by a two-part folding hinge 6. Each hinge 6 has upper and lower elongate hinge members 7, 8 which are pivotally linked together and are shown in more details in FIGS. 4 and 5.

Each hinge member 7, 8 has a pair of opposite substantially straight, parallel edges. The lower edge 5 of each shutter panel 3 is pivotally attached to the upper edge 9 of an upper hinge member 7. The lower edge 10 of the upper hinge member 7 is pivotally attached to the upper edge 11 of the lower hinge member 8, the lower edge 12 of the lower hinge member 8 is pivotally attached to the upper edge 4 of the shutter panel 3A which is adjacent, or next lower in the series, to the shutter panel 3.

Each shutter panel has a planar middle portion 13 extending between the upper and lower edges 4, 5 of the panel. Each of the upper and lower edges 4, 5 of each shutter panel is terminated by a bead 14 which extends along the respective edge. The bead 14 has a transverse cross-sectional outline that is a part circle.

FIG. 6 shows a shutter panel 3 which is extruded from aluminium or an aluminium alloy. The panel has a bead 14 at each upper and lower edge 4, 5. The bead may be hollow, as shown, to reduce the weight of the panel and to save on material costs.

FIG. 7 shows an alternative shutter panel 3B which is made from a plastics material. The panel has a bead 14 at each upper and lower edge 4, 5. The plastics panel may be moulded from a plastics material, for example a polycarbonate, and may be transparent.

Figure 8:
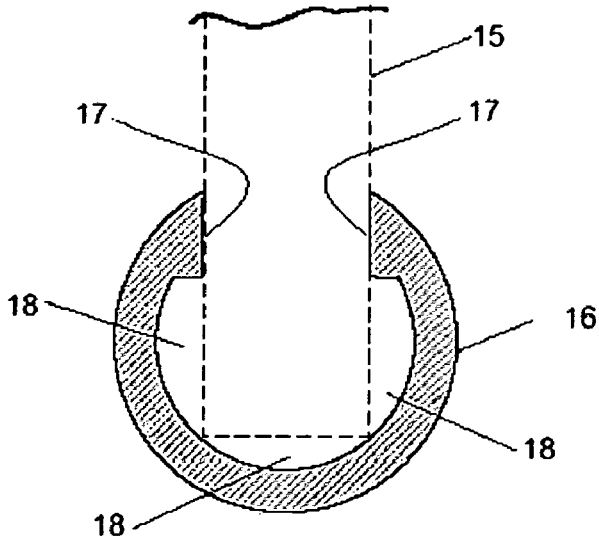
FIG. 8 is a transverse cross-section of a capping for use in a further alternative shutter panel for use in the shutter seen in FIGS. 1 to 3.

In a further alternative shutter panel, the middle planar portion 13 is a sheet of glass 15 (a fragment of which is shown in FIG. 8 by broken lines). Preferably the glass is tempered or laminated or otherwise strengthened to resist fracture or fragmentation. In this case the bead 14 at each of the upper and lower edges 4, 5 of the panel is provided by a capping 16 with a C-shaped transverse cross-section.

FIG. 8 shows the C-shaped cross-section of the capping 16. The inner opposite faces 17 of the ends of the C-shape are planar and parallel, and spaced apart by a distance approximately equal to the thickness of the glass sheet 15. The cappings are attached to the edges of the glass sheet 15 by an adhesive (not shown). The cavities 18 between the glass sheet and the inside face of the C-shaped capping can accommodate the adhesive. The outer surface of the C-shape of the capping is a part circle. The capping is an extrusion of aluminium or aluminium alloy.

The shutter panels and the hinge members 7, 8 are generally elongate with a length sufficient to span the generally horizontal width of the opening to be closed by the shutter and engage the generally vertical guide tracks at each side of the opening. Each of the panels and hinge members has a transverse cross-section that is constant along their length. The hinge members 7, 8 are preferably each extruded from aluminium or an aluminium alloy.

Figure 4:
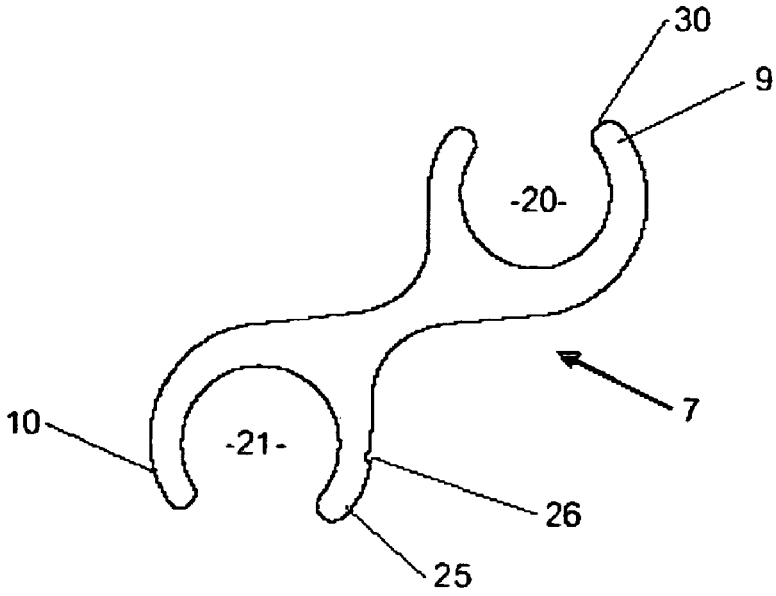
FIG. 4 is a transverse cross-section of a first hinge member of the shutter seen in FIGS. 1 to 3.

As best seen in FIG. 4, the upper edge 9 of each upper hinge member 7 is formed with a longitudinally-aligned socket 20 having a circular cross-sectional shape. The socket 20, which is formed by two partly-encircling arms, is pivotally engaged about the bead 14 (which has a partly circular cross-sectional shape) at the lower edge 5 of a shutter panel 3 to which the socket 20 is fitted. The lower edge 10 of each upper hinge member 7 is formed with a socket 21, having a circular cross-sectional shape (similar to that of the socket 20 at the upper edge 9 of the upper hinge member 7), which is pivotally engaged about a bead 22 (with a partly circular cross-sectional shape) formed at the upper edge 11 of the lower hinge member 8, as best seen in FIG. 5.

As best seen in FIG. 5, the lower edge 12 of each lower hinge member 8 is formed with a socket 23 having a circular cross-sectional shape. This socket 23, which is formed by two partly-encircling arms, is pivotally engaged about the bead 14 at the upper edge 4 of a shutter panel 3 to which it is fitted. The hinge member 8 also has a longitudinally extending groove 24 which accommodates the distal tip of an arm 25 at the lower edge 10 of the upper hinge member 7 when the hinge members fold into a zigzag configuration, explained further below and shown in FIG. 2.

One or both of the hinge members 7, 8 may be provided with a distinguishing mark, for example groove 26 provided on arm 25 of the upper hinge member 7. The distinguishing mark or marks can be used to distinguish the two hinge members from one another and to indicate orientation. Such a distinguishing mark can help ensure correct assembly of the shutter components. The groove 26 plays no part in the operation of the shutter once assembled.

Each of the sockets pivotally engages a respective bead to allow the shutter to wrap around a roller (not shown and which, in a complete shutter door assembly, is mounted in the vicinity of the upper end of the guide tracks 2) and to permit the shutter panels 3 and hinge members 7, 8 to lie in a zig-zag arrangement in the guide tracks when the shutter is closed.

The sockets 20, 23 of the hinge members pivot about the beads 14 on the upper and lower edges 4, 5 of the shutter panels 3 but limit the range of pivotal rotation of the hinge members 7, 8 relative to the respective adjacent shutter panels 3. This constraint in the angular pivotal range forces the zig-zagging hinge members in the guide tracks to maintain an offset of the axis of the pivotal attachment between adjacent hinge members to one side of an imaginary plane joining the pivotal axes of those hinge members to adjacent panels. That is, the two hinge members are always in a bent or folded configuration: the constraint prevents them from straightening out; or from becoming co-planar. This configuration may be seen in FIG. 3. This bent configuration guarantees that the hinge members of each hinge will always fold to the same rear side of the track and therefore keep both upper and lower edges of each shutter panel adjacent the other side of each guide track.

The distal ends of the arms of the hinge member sockets 20, 23 engage the planar portion 13 of the shutter panel 3 where it meets the bead 14 to provide a limit to the pivotal rotation of the hinge members when straightening out relative to the shutter panels.

FIGS. 11 to 14 show aspects of an alternative shutter assembly which includes a door or shutter 101. The two side edges of the shutter respectively slide in a pair of parallel guide tracks 2. The shutter, when raised to an open configuration, is rolled about a rotatable roller (not shown) which is mounted above the top ends of the guide tracks.

Figure 13:
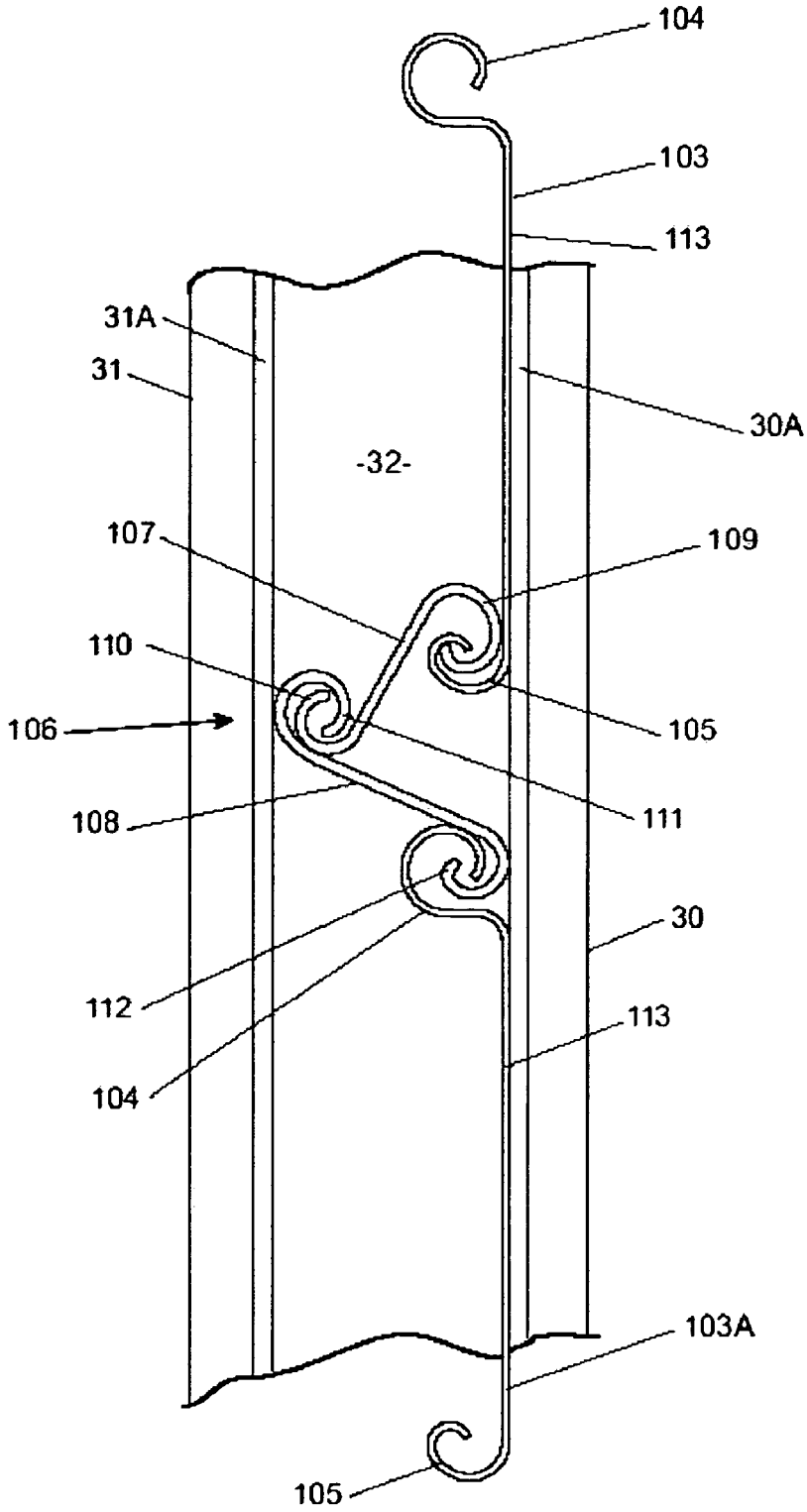
FIG. 13 shows an enlarged view of a portion of FIG. 12.
Figure 17:
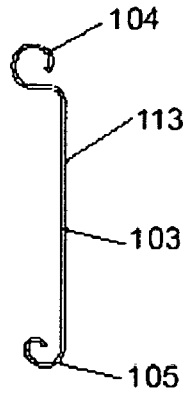
FIG. 17 is a transverse cross-section of a shutter panel of the shutter seen in FIGS. 11 to 14.

The shutter includes a series of shutter panels 103, 103A more details of which are shown in FIGS. 13 and 17. Each shutter panel has upper and lower rolled edges 104, 105 which are straight and parallel, and are generally perpendicular to the guide tracks.

Figure 15:
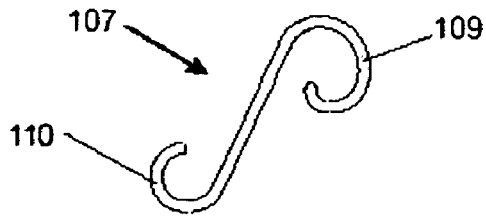
FIG. 15 is a transverse cross-section of a first hinge member of the shutter seen in FIGS. 11 to 14.
Figure 16:
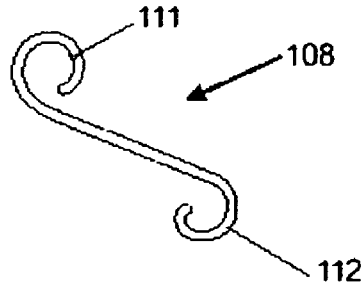
FIG. 16 is a transverse cross-section of a second hinge member of the shutter seen in FIGS. 11 to 14.

Adjacent shutter panels in the series are pivotally connected together by a two-part folding hinge 106. Each hinge 106 has upper and lower elongate hinge members 107, 108 which are pivotally linked together and are shown in more detail in FIGS. 13, 15 and 16.

Each hinge member 107, 108 has a pair of opposite substantially straight, parallel rolled edges. Each of the upper and lower edges 109, 110, 111, 112 of each hinge member 107, 108 is rolled to an almost closed curve as may be best appreciated from FIGS. 13, 15 and 16.

Each shutter panel has a planar middle portion 113 extending between the upper and lower rolled edges 104, 105 of the panel: Each of-the upper and lower edges 104, 105 of each shutter panel is rolled to an almost closed curve as may be best appreciated from FIGS. 13 and 17.

The lower edge 105 of a shutter panel 103 is pivotally attached to the upper edge 109 of an upper hinge member 107. The lower edge 110 of the upper hinge member 107 is pivotally attached to the upper edge 111 of the lower hinge member 108, the lower edge 112 of the lower hinge member 108 is pivotally attached to the upper edge 104 of the shutter panel 103A which is adjacent, or next lower in the series, to the shutter panel 103.

Figure 12:
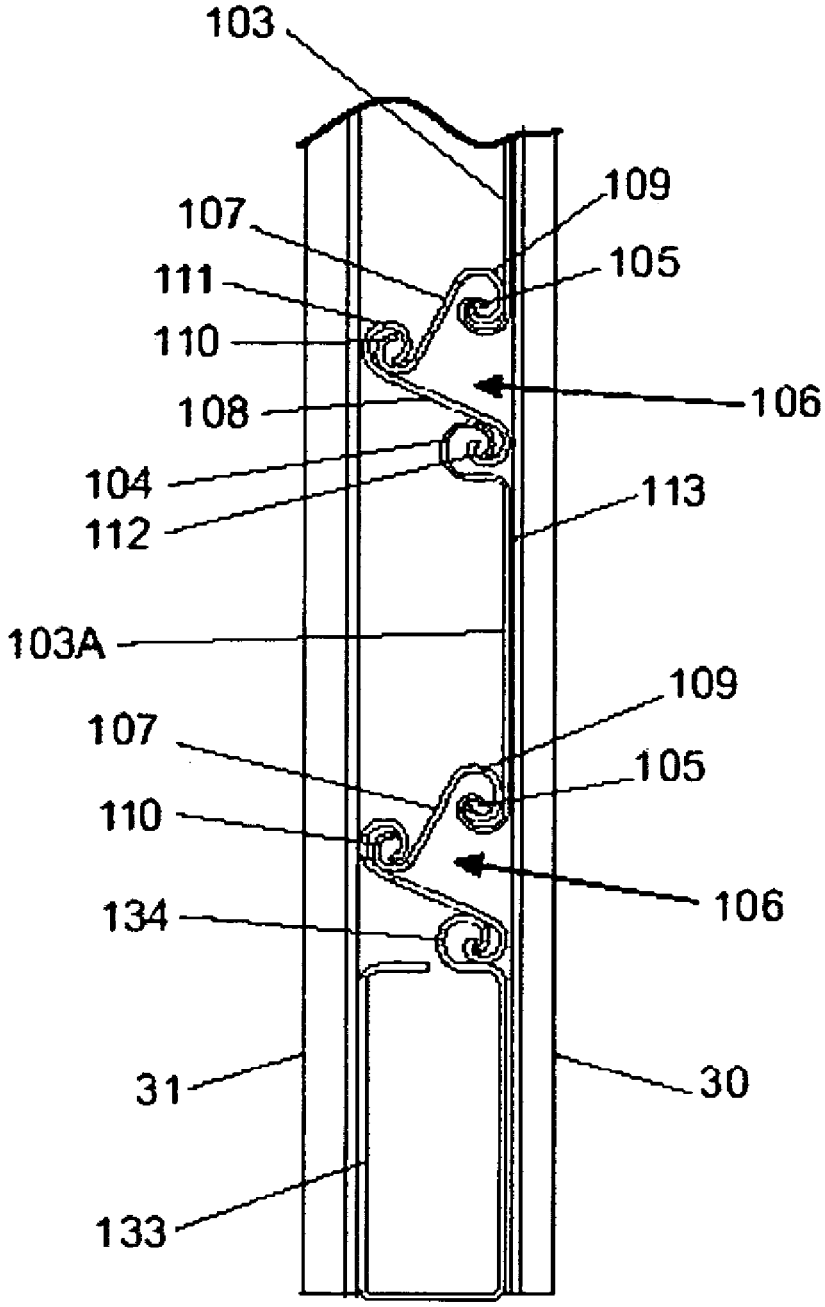
FIG. 12 shows an end elevation of the fragment of the rolling shutter assembly as seen at line B-B' of FIG. 11, with the shutter resting on the bottom of the opening.
Figure 14:
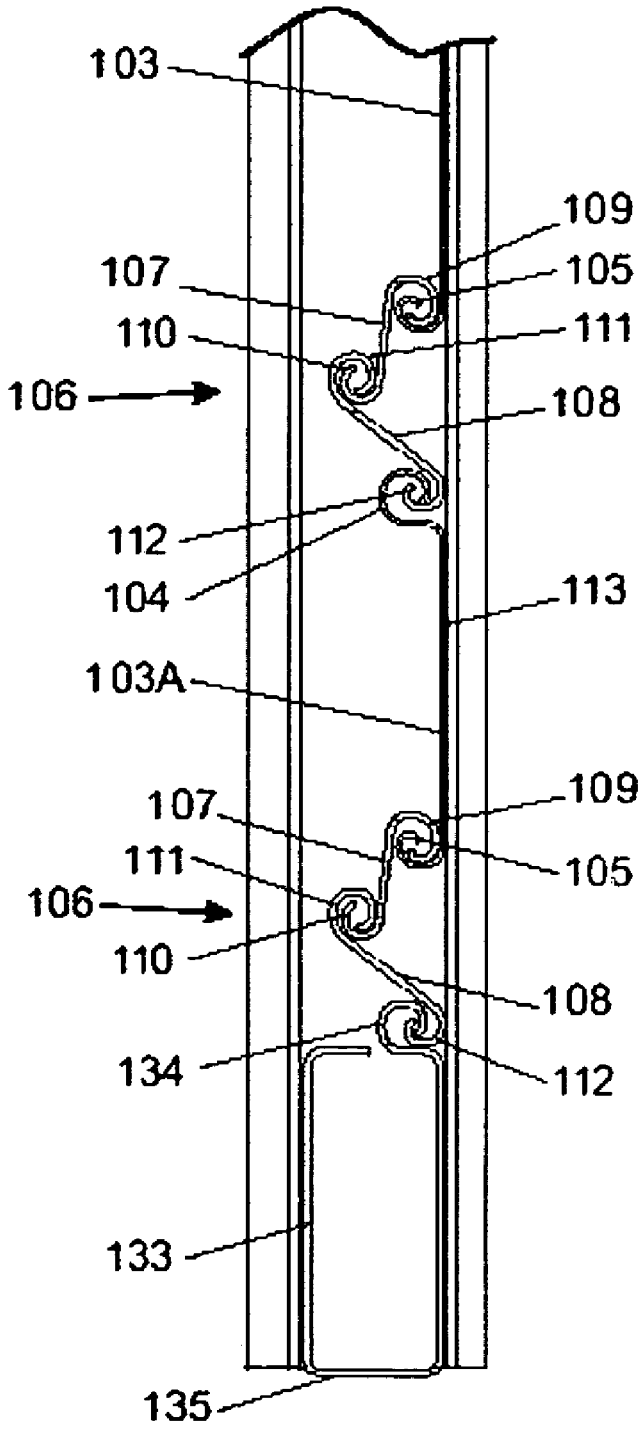
FIG. 14 shows an end elevation of the fragment of the rolling shutter assembly as seen at line B-B' of FIG. 11, with the shutter suspended and only partly closed over the opening.

The curved edge portions of the panels and upper and lower hinge members are preferably rolled with an orientation that does not encourage the collection and accumulation of dirt and water in the pivotal attachments between edges of the panels and hinge members. For example, the cross-sectional views of FIGS. 12, 13 and 14, show the exterior face of the shutter 101 as directed towards the right side of the Figures and each curved edge portion curling clockwise.

The shutter panels 103, 103A and the hinge members 107, 108 are generally elongate with a length sufficient to span the generally horizontal width of the opening to be closed by the shutter and engage the generally vertical guide tracks 2 at each side of the opening. Each of the panels and hinge members has a transverse cross-section that is substantially constant along their length. The shutter panels 103, 103A and hinge members 107, 108 are preferably shaped by roll forming a flat sheet. The flat sheet may be a strip of suitable width drawn from a bulk roll as is well known in the art. The strip is preferably steel, and more preferably coated e.g. by a galvanising zinc and/or a paint finish.

The direction, extent and radii of the curvature of the rolled edges are such that adjacent panels and hinge members can be coupled together for pivoting about one another to allow the shutter to wrap around a roller (not shown and which, in a complete shutter door assembly, is mounted in the vicinity of the upper end of the guide tracks 2) and to permit the shutter panels 103, 103A and hinge members 107, 108 to lie in a zig-zag arrangement in the guide tracks when the shutter is closed.

Each of the guide tracks 2 is generally U-shaped, having opposite parallel front and rear walls 30, 31. The front wall 30 and the rear wall 31 are joined by a third, linking wall 32, as may be best appreciated from FIGS. 1 and 11. As the shutter opens and closes, the shutter panels and hinge members slide up and down, guided between the front and rear walls of the guide tracks. The third wall 32 limits end-wise movement of the shutter panels and hinge members, i.e. side ways movement of the shutter, when the shutter is closed.

The upper end of the shutter is attached to a roller (not shown) located in the vicinity of the upper end of the guide tracks 2. The roller axis is aligned parallel to the elongate direction of the shutter panels and hinge members. The roller rotates about its axis and the shutter wraps around the roller as the shutter rises (i.e. retracts from the shutter opening) to open the space between the guide tracks. The roller rotates about its axis and the shutter unwraps from the roller as the shutter falls, to close the shutter over the opening between the guide tracks. In the preferred and usual application the guide tracks are vertical and the roller axis is horizontal.

When the shutter assembly is closed, i.e. the lower part of the shutter is resting on a supporting surface, such as the ground or sill at the bottom of the shutter opening, the weight of the shutter above each hinge causes the hinge to fold and zigzag across the full internal width between the front and rear walls of each guide track as shown in FIGS. 2, 12 and 13.

Each hinge 6, 106 is dimensioned so that when folded it jams between the opposing inside surfaces of the front and rear walls 30, 31. As the shutter is lowered, each hinge jams automatically as the hinge bears the weight of the higher shutter parts that are then lowered onto it. This jamming action resists an attempt to open the shutter by lifting from below. Each hinge 6, 106, when jammed as described above, will resist an attempt to open the shutter by lifting the shutter from a point below the hinge. Such an attempt only forces further folding of the hinge which only jams the hinge more tightly between the front and rear walls of the guide track. The depth dimension of each hinge member 7, 8, 107, 108 is such that, as the hinge 6, 106 folds, the hinge jams between the front and rear guide track walls 30, 31 before the hinge can become fully folded.

It is desirable that the hinge members of each hinge fold to a configuration having an acute included angle therebetween, so that edges of the hinge members are forced against the walls of the guide tracks at an angle that is almost perpendicular to the walls. This enhances the frictional jamming action, and also reduces the height of the folded hinge and the visual impact of the hinge on the overall appearance of the shutter when closed. The appearance of the closed shutter is then predominantly that of the planar portions of the shutter panels which, if made of transparent plastic or glass as in the case of the panels described with reference to FIGS. 7 and 8, provide a shutter which, when closed, is predominantly transparent.

The jamming action also restrains the shutter against horizontal movement perpendicular to the shutter and stops the shutter from rattling in the guide tracks such as when wind or an unbalanced air pressure acts on the shutter.

Furthermore, the jamming action resists the tendency of the zigzagging shutter to flatten and rise when a force is applied perpendicularly to the general plane of the shutter.

A part or all of the inside surface of each of the front and rear walls 30, 31 of the guide tracks 2 can be lined, e.g. with a plastic or rubber strip 30A, 31A, to increase friction between them and the upper and lower edges of the hinge members to improve the jamming action. The strips may be resilient and/or may have a textured surface to enhance frictional engagement between the strip and hinge members. The inside surface of each of the three walls 30, 31, 32 of the guide tracks 2 can be lined, e.g. with plastic or rubber, to prevent metal-to-metal contact between the hinge members and the walls of the guide tracks. This lining can also help reduce the noise caused by the movement of the shutter assembly in the track, e.g. during opening and closing of the shutter.

When the shutter is lifted from above, such as by rotating the roller to open the shutter, each folded hinge tends to straighten and automatically un-jam as the top edge of its upper hinge member is lifted. As noted above, the hinges can be constrained to not straighten completely. This configuration is shown in FIGS. 3 and 14. When in this almost-straightened configuration, the hinge members do not extend completely between the opposite walls of the guide tracks, but allow the shutter to slide freely up or down in the guide tracks.

When a hinge is jammed in vertical guide tracks, e.g. when the shutter is closed, the upper edge of the upper member of the hinge and the lower edge of the lower member of the hinge lie on a common vertical plane. This configuration is shown in FIGS. 2, 12 and 13. When shutter panels as described above are bounded above and below by hinges jammed as described, the planar portions of the shutter panels are held in a common vertical plane by the co-planar alignment of the upper and lower edges of the jammed hinge members.

Figure 9:
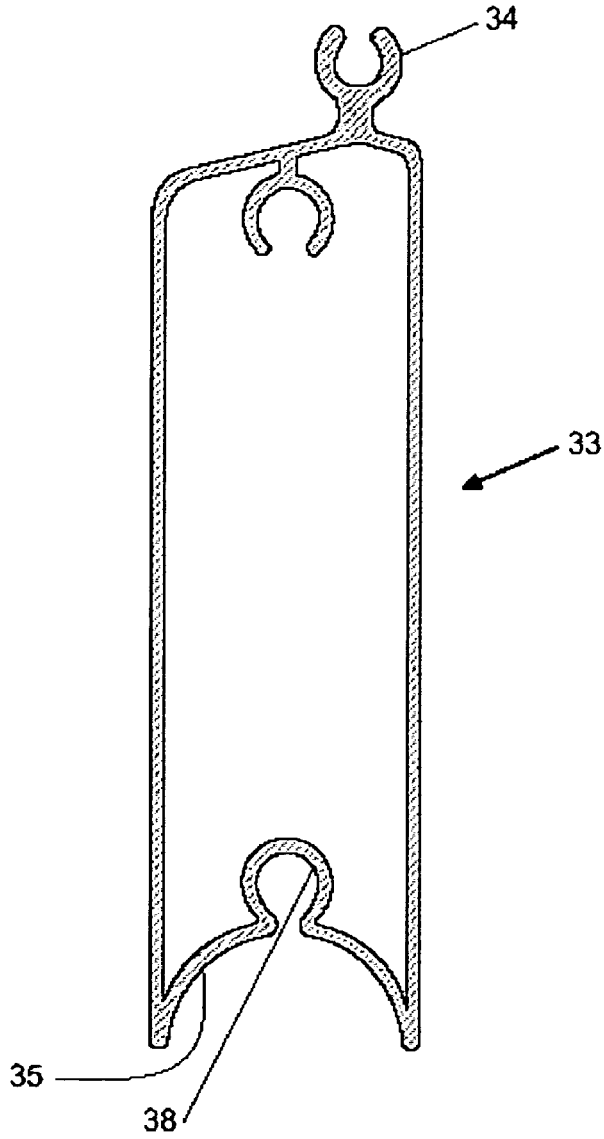
FIG. 9 is a transverse cross-section of a bottom member of the shutter seen in FIGS. 1 to 3.
Figure 18:
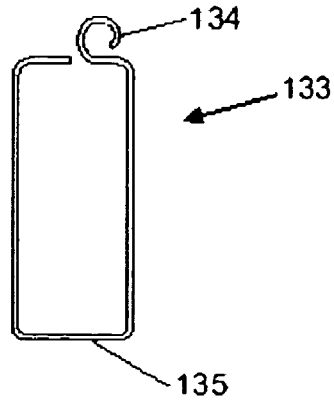
FIG. 18 is a transverse cross-section of a bottom member of the shutter seen in FIGS. 11 to 14.

The lower end of the shutter is provided with a bottom rail 33, 133 as seen in FIGS. 1, 2, 3, 11, 12, 14 and particularly in the cross-sectional views of FIGS. 9 and 18.

In the bottom rail 33 of FIGS. 1, 2 and 9, a bead 34, with a circular transverse cross-section, extends along the top of the bottom rail and is engaged by the socket 23 at the lower edge 12 of the lower hinge member 8 of the hinge 6 immediately above the bottom rail. This bottom rail 33 is preferably extruded, e.g. from aluminium or an aluminium alloy.

Figure 10:
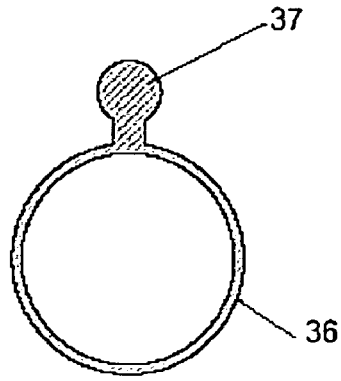
FIG. 10 is a transverse cross-section of a lower weather seal of the shutter seen in FIGS. 1 to 3.
Figure 11:
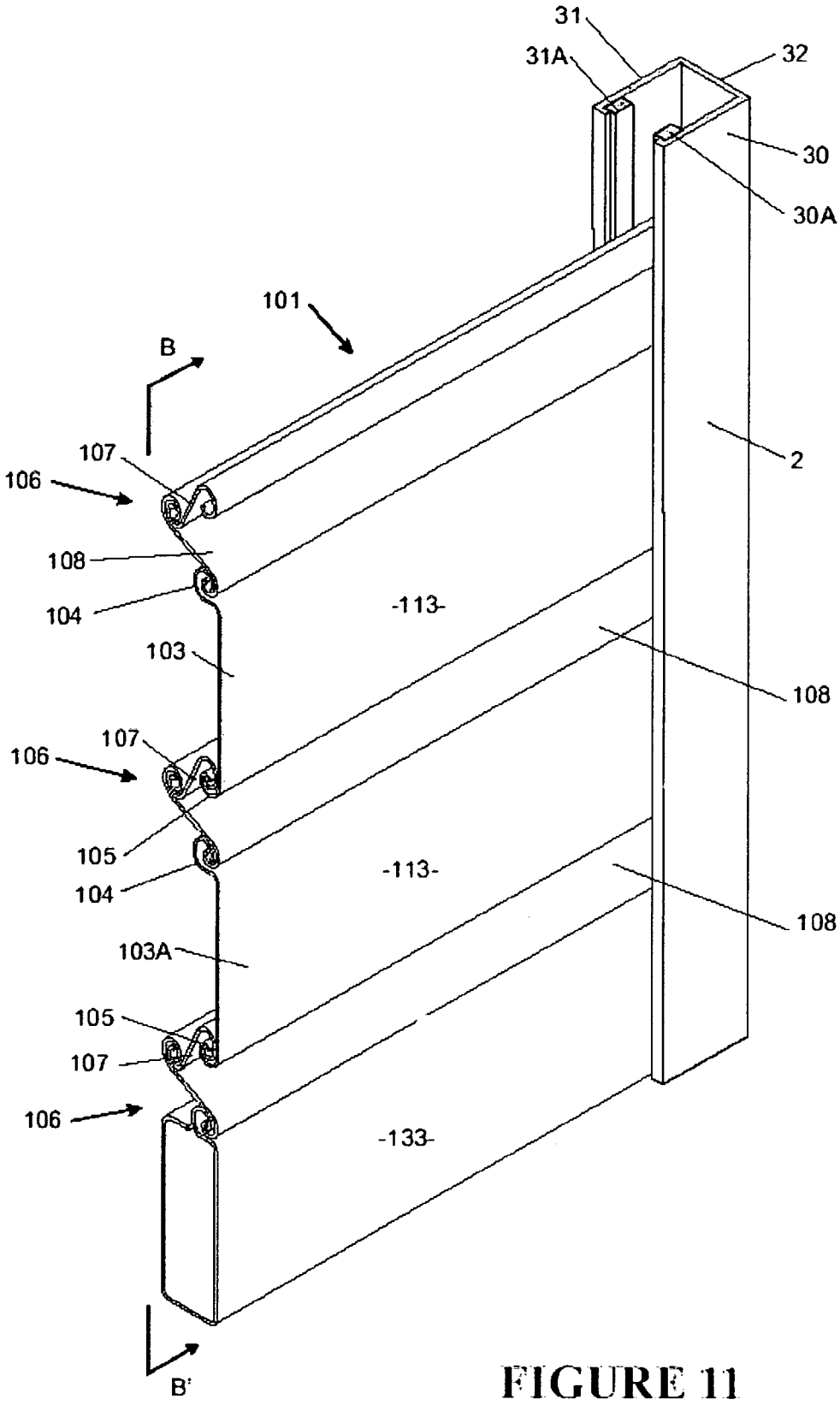
FIG. 11 shows a perspective front view of a lower right corner fragment of an alternative rolling shutter assembly having a shutter which is closed over an opening.

A hollow 35, having a concave, generally semicircular, transverse cross-section, extends along the underside of the bottom rail 33. The hollow 35 accommodates a circularly cross-sectioned tubular weather seal 36, which is shown in detail in the cross-sectional view of FIG. 10. The weather seal has a bead 37 by which the seal is attached to the under side of the bottom rail 33 by engagement of the bead 37 in a complementary socket 38 in the hollow underside of the bottom rail 33.

The bottom rail 133, of FIGS. 11, 12, 14 and 18, has a rolled edge 134 which extends along the top of the bottom rail and is engaged by the rolled lower edge 112 of the lower hinge member 108 of the hinge 106 immediately above the bottom rail 133. This bottom rail 133 is preferably roll formed, e.g. from a flat sheet as described above, into a generally closed box section with a substantially flat bottom 135.

The foregoing describes the invention including preferred forms thereof. Alterations and modifications as will be obvious to those skilled in the art are intended to be incorporated within the scope of the invention as defined in the accompanying claims.

It is to be understood that the numerical references included in parentheses in the following claims are given merely as a guide in understanding the correspondence between integers of the claims and the features of the exemplary but non-limiting embodiments shown in the figures. The claims are not intended to be limited to the features or arrangements as shown in the figures.

List of features labelled in the drawings:

shutter 1, 101
guide track 2
shutter panels 3, 3A, 3B, 103, 103A
upper edge 4, 104 (of shutter panel)
lower edge 5, 105 (of shutter panel)
two-part folding hinge 6, 106
upper hinge members 7, 107
lower hinge member 8, 108
upper edge 9, 109 (of upper hinge member)
lower edge 10, 110 (of upper hinge member)
upper edge 11, 111 (of lower hinge member)
lower edge 12, 112 (of lower hinge member)
planar portion 13, 113
bead 14 (on upper & lower edges of shutter panel)
glass sheet 15
capping 16
inner face 17
cavity 18
socket 20 (at upper edge of upper hinge member)
socket 21 (at lower edge of upper hinge member)
circular bead 22 (at upper edge of lower hinge member)
socket 23 (at lower edge of lower hinge member)
groove 24
arm 25
groove 26
front wall 30 (of guide track)
strip 30A (on front wall)
rear wall 31 (of guide track)
strip 31A (on rear wall)
linking wall 32 (of guide track)
bottom rail 33, 133
bead 34 (on bottom rail 33)
rolled top edge 134 (of bottom rail 133)
hollow 35 (on bottom rail 33)
flat bottom 135 (of bottom rail 133)
weather seal 36
bead 37 (on weather seal)
socket 38 (on underside of bottom rail 33)

The invention claimed is:

1. A rolling shutter assembly comprising a shutter, wherein:

the shutter includes a series of shutter panels, each panel having first and second opposite substantially straight edges, adjacent shutter panels in the series are pivotally connected together by first and second pivotally linked hinge members, each hinge member has first and second opposite substantially straight edges, the second edge of a first said shutter panel is pivotally attached by a first pivotal attachment to the first edge of the first hinge member, the second edge of the first hinge member is pivotally attached by a second pivotal attachment to the first edge of the second hinge member, the second edge of the second hinge member is pivotally attached by a third pivotal attachment to the first edge of a second shutter panel, the second shutter panel is adjacent to said first shutter panel, and the angular pivotal range of at least one of said pivotal attachments is constrained to maintain the pivotal axis of the second pivotal attachment offset to one side of an imaginary plane in which the pivotal axes of the first and third pivotal attachments lie;

a pair of guide tracks, wherein:

each of the shutter panels has a pair of opposite substantially parallel side edges which are substantially perpendicular to said first and second edges of the shutter panels, each of the hinge members has a pair of opposite substantially parallel side edges which are substantially perpendicular to said first and second edges of the hinge members, each guide track has a pair of substantially parallel side walls (30, 31), each said side edge slides between said substantially parallel side walls of one or other of the guide tracks to guide the shutter as the shutter moves between opened and closed states, and each said side edge is engaged between said substantially parallel side walls of one or other of the guide tracks when the shutter is closed;

wherein each pair of first and second hinge members pivotally connecting adjacent shutter panels in said series is configured to open when an upwardly directed force is applied to the upper edge of the upper one of said pair of hinge members while a downwardly directed force is applied to the lower edge of the lower one of said pair of hinge members and, when thus opened, to be dimensioned to be freely slidable up or down between each pair of parallel side walls of the guide tracks, and said pair of first and second hinge members is configured to close when a downwardly directed force is applied to the upper edge of the upper one of said pair of hinge members while an upwardly directed force is applied to the lower edge of the lower one of said pair of hinge members and, when thus forced toward a closed configuration, is dimensioned to jam between each pair of parallel side walls of the guide tracks.

2. The rolling shutter assembly as claimed in claim 1, wherein the upper edge of the upper one of each said pair of hinge members and the lower edge of the lower one of each said pair of hinge members lie on a substantially common plane when each said pair of hinge members is jammed between the parallel walls of the guide tracks.

3. The rolling shutter assembly as claimed in claim 1 wherein each shutter panel (3, 3A) has a substantially planar portion (13) which extends between said first and second edges (4, 5) of the shutter panel, and each of the first and second edges (4, 5) of each shutter panel is terminated by a bead (14) which extends along the respective edge and has a partly circular transverse cross-sectional outline.

4. The rolling shutter assembly as claimed in claim 3, wherein the substantially planar portion (13) of each shutter panel is made from glass and each beaded edge (14) is provided by fitting a capping (16) having a C-shaped transverse cross-section to the planar glass portion (15), along each of said first and second edges (4, 5) of the panel, the C-shaped cross-section having a substantially circular outline.

5. The rolling shutter assembly as claimed in claim 3, wherein each hinge member is elongate and has a transverse cross-section which is substantially constant along the length of the hinge member, the first and second edges (9, 10) of the first hinge member (7) and the second edge (12) of the second hinge member (8) are each shaped to form a socket (20, 21, 23) with a partly circular transverse cross-section, a bead (22) extends along the first edge (11) of the second hinge member (8) and has a partly circular transverse cross-sectional outline, and said pivotal attachments are provided by respective engagement of said beads (14, 22) inside said sockets (20, 21, 23).

6. The rolling shutter assembly as claimed in claim 5, wherein each hinge member is extruded from aluminium or an aluminium alloy.

7. The rolling shutter assembly as claimed in claim 5, wherein the beads and sockets are configured to provide said constraint.

8. The rolling shutter assembly as claimed in claim 2 wherein each shutter panel (3, 3A) has a substantially planar portion (13) which extends between said first and second edges (4, 5) of the shutter panel, and each of the first and second edges (4, 5) of each shutter panel is terminated by a bead (14) which extends along the respective edge and has a partly circular transverse cross-sectional outline.

9. The rolling shutter assembly as claimed in claim 8, wherein the substantially planar portion (13) of each shutter panel is made from glass and each beaded edge (14) is provided by fitting a capping (16) having a C-shaped transverse cross-section to the planar glass portion (15), along each of said first and second edges (4, 5) of the panel, the C-shaped cross-section having a substantially circular outline.

10. The rolling shutter assembly as claimed in claim 9, wherein the glass is tempered and the C-shaped capping is an extrusion of aluminium or aluminium alloy which is attached to the planar glass portion using an adhesive.

11. The rolling shutter assembly as claimed in claim 8, wherein each hinge member is elongate and has a transverse cross-section which is substantially constant along the length of the hinge member, the first and second edges (9, 10) of the first hinge member (7) and the second edge (12) of the second hinge member (8) are each shaped to form a socket (20, 21, 23) with a partly circular transverse cross-section, a bead (22) extends along the first edge (11) of the second hinge member (8) and has a partly circular transverse cross-sectional outline, and said pivotal attachments are provided by respective engagement of said beads (14, 22) inside said sockets (20, 21, 23).

12. The rolling shutter assembly as claimed in claim 11, wherein each hinge member is extruded from aluminium or an aluminium alloy.

13. The rolling shutter assembly as claimed in claim 11, wherein the beads and sockets are configured to provide said constraint.

* * * * *